US008167089B2

(12) United States Patent
Castle

(10) Patent No.: US 8,167,089 B2
(45) Date of Patent: May 1, 2012

(54) LIFTABLE SCAFFOLD

(75) Inventor: Jerry Castle, Schaumburg, IL (US)

(73) Assignee: Bennu Parts and Service, Inc., Elk Grove, IL (US)

( * ) Notice: Subject to any disclaimer, the term of this patent is extended or adjusted under 35 U.S.C. 154(b) by 825 days.

(21) Appl. No.: 12/014,227

(22) Filed: Jan. 15, 2008

(65) Prior Publication Data

US 2009/0178883 A1 Jul. 16, 2009

(51) Int. Cl.
*E04G 1/20* (2006.01)

(52) U.S. Cl. ..... 182/141

(58) Field of Classification Search ..... 182/141
See application file for complete search history.

(56) References Cited

U.S. PATENT DOCUMENTS

| | | | | | |
|---|---|---|---|---|---|
| 620,074 | A | * | 2/1899 | Jamieson | 74/416 |
| 3,071,205 | A | | 1/1963 | Beck, Jr. | |
| 3,749,504 | A | * | 7/1973 | Smith | 404/84.2 |
| 3,779,662 | A | * | 12/1973 | Smith | 404/98 |
| 3,924,710 | A | * | 12/1975 | Shohet | 187/270 |
| 3,949,356 | A | * | 4/1976 | Fuzzell et al. | 340/459 |
| 4,293,054 | A | | 10/1981 | Pieri | |
| 4,294,332 | A | * | 10/1981 | Ready | 182/141 |
| 4,373,332 | A | * | 2/1983 | Holmen | 60/426 |
| 4,763,800 | A | * | 8/1988 | Engler et al. | 212/195 |
| 4,809,814 | A | | 3/1989 | St-Germain | |
| 5,159,989 | A | * | 11/1992 | Claxton | 180/41 |
| 5,259,479 | A | | 11/1993 | St-Germain | |
| 5,368,125 | A | | 11/1994 | St-Germain | |
| 5,392,878 | A | | 2/1995 | Bennett et al. | |
| 5,579,865 | A | | 12/1996 | Butler et al. | |
| 5,746,290 | A | | 5/1998 | St-Germain et al. | |
| 5,784,871 | A | * | 7/1998 | Glancey et al. | 56/327.1 |
| 6,095,285 | A | | 8/2000 | St-Germain | |
| 6,311,800 | B1 | * | 11/2001 | St-Germain et al. | 182/146 |
| 6,523,647 | B2 | | 2/2003 | Duplessis | |
| 6,883,643 | B2 | | 4/2005 | Robillard | |
| 7,178,333 | B2 | | 2/2007 | Oka | |
| 2004/0020717 | A1 | | 2/2004 | Robillard | |

* cited by examiner

*Primary Examiner* — Katherine w Mitchell
*Assistant Examiner* — Daniel Cahn
(74) *Attorney, Agent, or Firm* — Vedder Price P.C.

(57) ABSTRACT

A system for lifting a platform includes a frame attached to the platform. The invention has at least one upright member having equally spaced holes longitudinally aligned, with each of the holes having an upper surface and a lower surface. A motor is attached to the frame, and a pinion is driven by the motor. The frame carries the motor and pinion. The pinion has a plurality of equally spaced teeth that radially extend from the pinion. Each tooth has a roller that is freely rotatable about its axis. The rollers roll over the lower surface of the holes when the motor rotates the pinion in a direction to raise or lower the frame and platform. A safety dog is attached to the frame to prevent the platform from falling if a motor were to fail.

3 Claims, 6 Drawing Sheets

LIFTABLE SCAFFOLD

BACKGROUND OF THE INVENTION

Easily adjustable scaffolding is desirable to increase construction worker productivity and reduce back strain on workers. Ideally, scaffolding should be constantly adjusted to a height that will permit workers to stand upright when working so that bending down or reaching above shoulder level is not necessary. If scaffolding is difficult to adjust, workers will be less likely to take the time to adjust their scaffolding to maintain an optimum working height. Liftable scaffolding that contains a mechanism for lifting itself is desirable.

Using a large span of scaffolding across the face of a building is desirable to eliminate the need for workers to make potentially dangerous changes between multiple platforms. Maintaining the scaffolding in a horizontal position across the entire span is important. Typically, scaffolding is supported by uprights near each end of the scaffolding. Changes must be made to the position of the scaffolding at each upright to change the overall height of the scaffolding. Therefore, when using multiple uprights to support the scaffolding, the scaffolding should move evenly up or down the uprights to maintain a horizontal position.

Such liftable scaffold systems should have a safety device in the event that the lifting mechanism fails. Such a safety device must prevent the scaffolding from falling if the lifting mechanism fails. The safety device should also be a passive system that requires no effort of the user to activate and will automatically prevent the scaffold from falling.

One method of providing a liftable scaffold is exemplified in U.S. Pat. No. 6,311,800. The scaffold has stationary members that have rack teeth protruding from them. The rack teeth protrude into an associated pinion between two opposing discs that define the sides of the pinion. The pinion is rotatably attached to a platform to be lifted. The two opposing discs hold rollers between them. The rollers spin freely. As the pinions are rotated, the rollers roll over the teeth and raise the platform.

SUMMARY OF THE INVENTION

The present invention relates to a system for lifting a platform. The system for lifting a platform includes a frame attached to the platform. The invention has at least one upright member having equally spaced holes longitudinally aligned, with each of the holes having an upper surface and a lower surface. A motor, preferably hydraulic, is attached to the frame, and a pinion is driven by the motor. The frame carries the motor and pinion. The pinion has a plurality of equally spaced, radially extending teeth. Each tooth has a roller that is freely rotatable about its axis. The rollers roll over the lower surface of the holes when the motor rotates the pinion in a direction to raise or lower the frame and platform.

In another aspect of the invention, the system for lifting a platform has a plurality of upright members, each upright member has a corresponding motor and pinion. Each motor is supplied fluid through a proportional control valve that directs and selectively restricts fluid flow to each motor. Each proportional control valve has solenoids on opposite sides of the valve that move the control valve to control fluid to the motor. The solenoids are responsive to electric signals to initiate movement of the control valves. A level sensor, for sensing the angle of the platform with respect to horizontal, provides the electric signals to actuate the solenoids so that each motor rotates its attached pinion to maintain each motor at an equal distance traveled along its upright member during raising or lowering of said platform.

In yet another aspect of this invention a safety dog is pivotally connected to the frame and is movable between a first and second position. A portion of the dog is extendable into one of the holes in the upright member when the dog is in its first position. The dog is retractable from the one hole in the upright member when the dog is pivoted into the second position. The dog is urged into the hole when it is in its first position by a spring connected to the dog and the frame. The dog is also pivotable into the second position when the dog strikes the upper surface of the hole as the frame and platform move upward relative to the upright member.

An object of the present invention is to provide a platform that may be smoothly raised and lowered.

Another object of the invention is to provide a platform that will move vertically and remain level while doing so.

Yet another object of the invention is to provide a safety mechanism which prevents the platform from falling if a lifting motor were to fail.

Still other objects of the invention will become apparent after reading the description of the invention below.

DETAILED DESCRIPTION OF INVENTION

Figure 1:
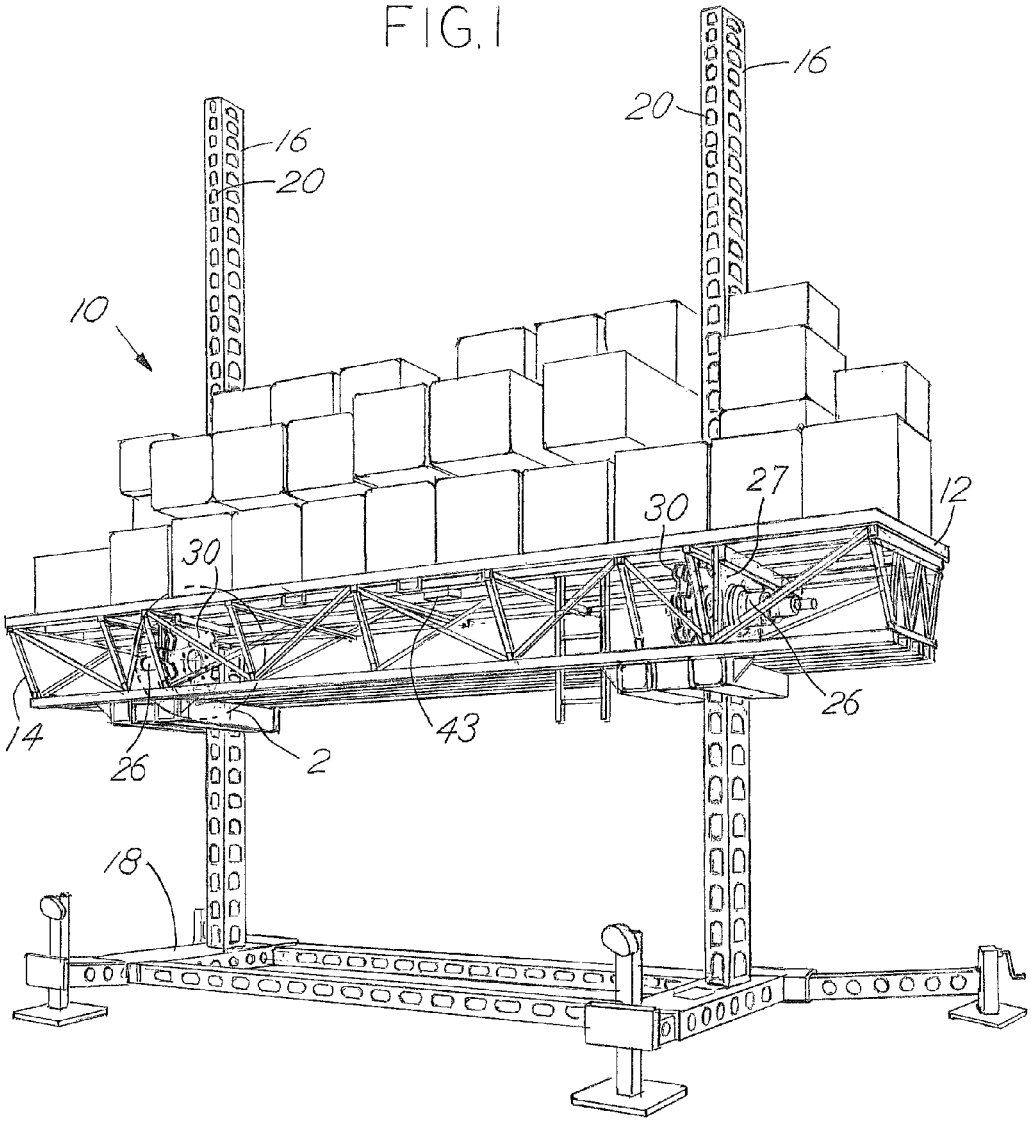
FIG. 1 is a perspective view of the liftable scaffold.
Figure 2:
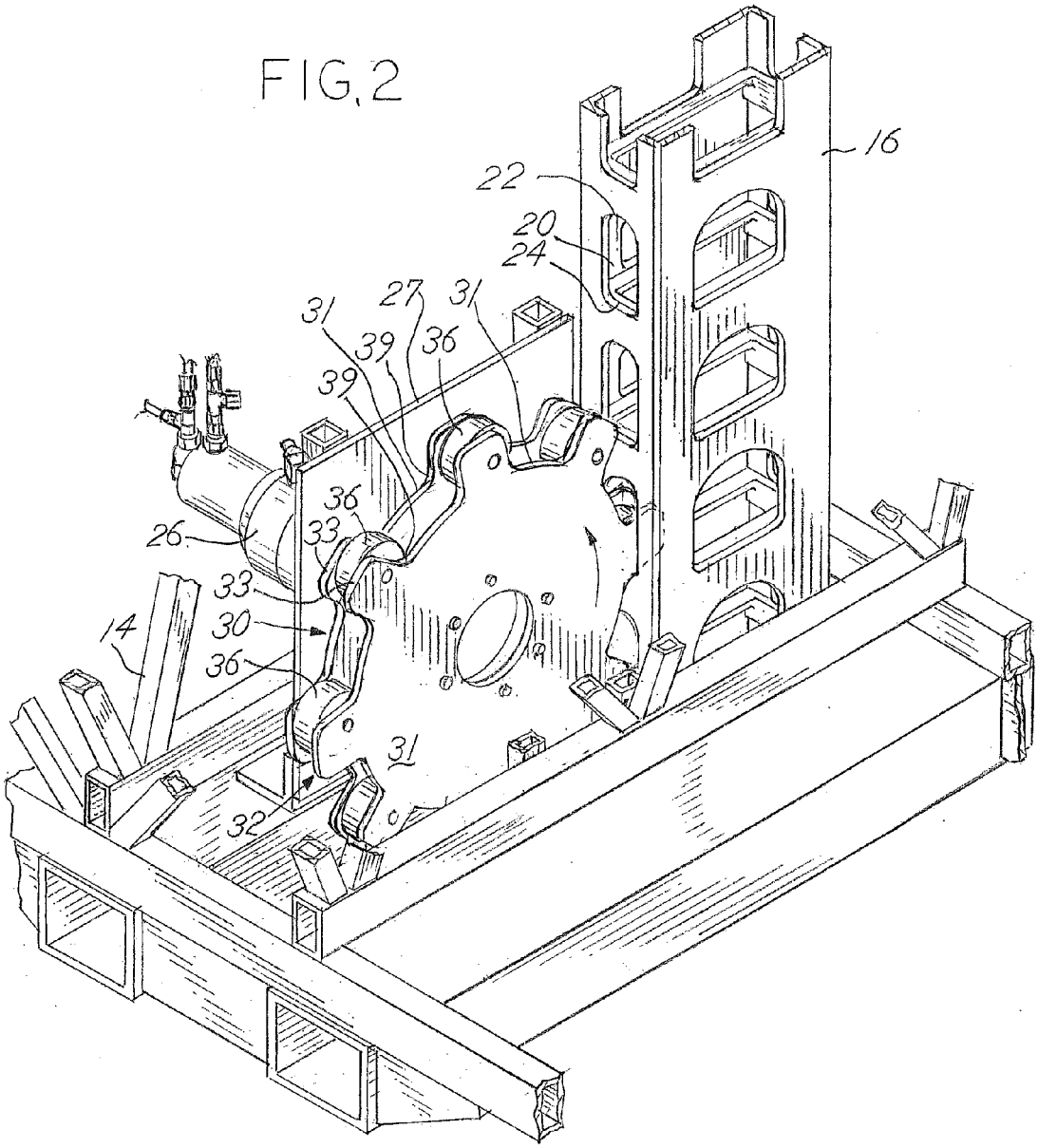
FIG. 2 is a perspective view of a pinion and attached motor showing teeth on the pinion engaged in an upright member with parts of the supporting fame supporting a platform removed.
Figure 3:
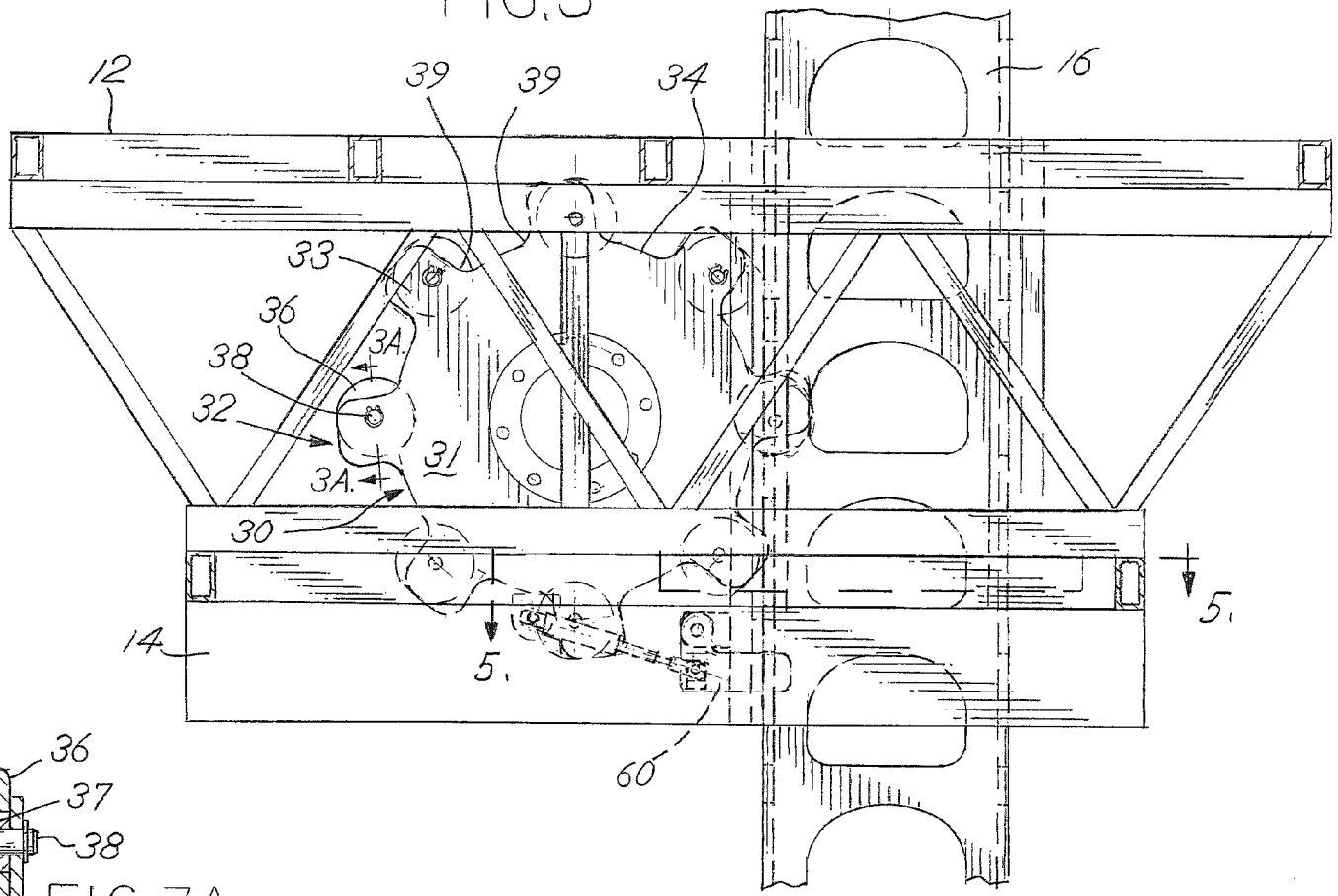
FIG. 3 is a side view of the pinion shown in FIG. 2 with the platform.
Figure 3A:
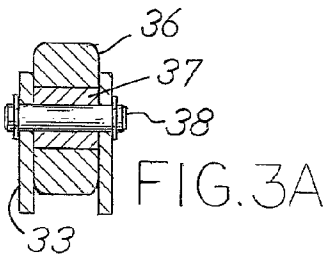
FIG. 3A is a sectional view of a tooth on the pinion and a roller taken along line 3A-3A of FIG. 3.
Figure 4:
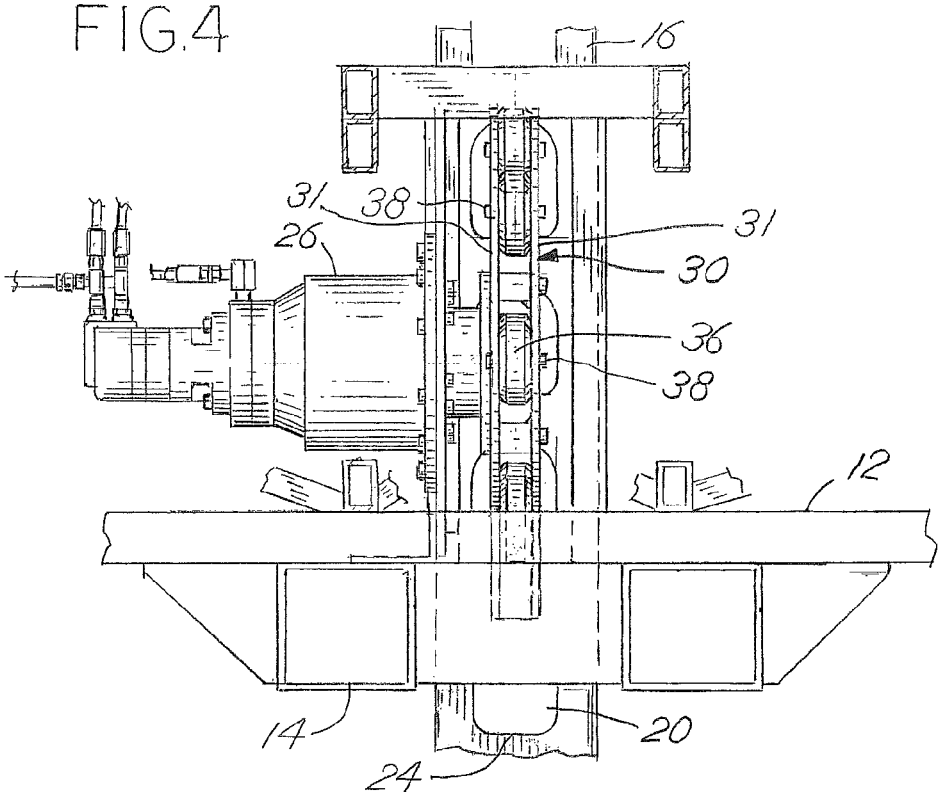
FIG. 4 is a front view of the pinion shown in FIG. 2 with parts of the frame removed.
Figure 5:
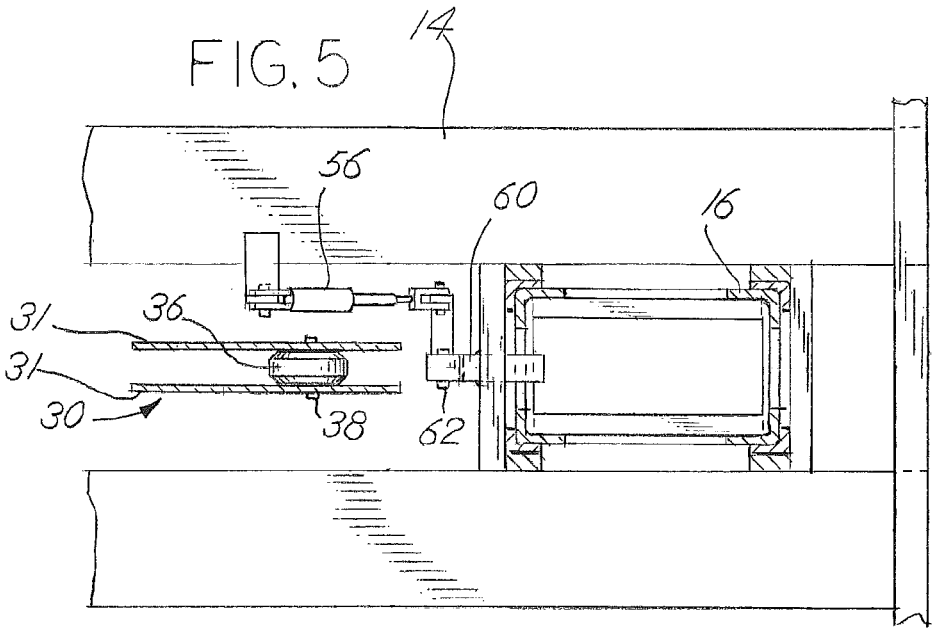
FIG. 5 is a top view of the safety dog in its first position engaged in a hole in the upright member.

The liftable scaffold 10 has a platform 12 including a frame 14. As shown in FIG. 1, two upright members 16 extend vertically upward and are attached to a base 18. The upright members 16 have a plurality of equally spaced holes 20 that are longitudinally aligned. Each of the holes has an upper surface 22 and a lower surface 24. Reinforcement plates 25 are welded to the inside of the upright members 16 to form a portion of the lower surface 24 of each hole 20. The reinforcement places 25 provide a broader lower surface 24 than just the thickness of the material in the upright members 16. A motor 26 is attached to the frame 14 by plate 27 as seen in FIGS. 1 and 2 at each upright member 16.

Each motor 26 has a pinion 30 attached to its drive shaft. The motors 26 turn on receipt of hydraulic fluid and rotate the pinions 30. Each pinion 30 has side plates 31 that have tabs 33 that extend radially from a minor diameter 34. The minor diameter 34 is a constant radial distance from the axis of rotation. Each pinion 30 has a plurality of equally radially and angularly spaced teeth 32 defined by the tabs 33 that extend radially from the pinion 30. Each tooth has a root 39 which is where the tooth 32 meets the minor diameter 34. Each tooth 32 has a roller 36 supported between two opposing tabs 33. Each roller 36 contains a journal bushing 37 that receives a shaft 38 that holds each roller rotatably within its respective tooth 32. The rollers 36 roll over the lower surfaces 24 of the holes 20 when the pinion 30 is engaged in the holes 20 in the upright member 16. As each motor 26 turns its associated pinion 30, the scaffold 10 will be moved on the upright members 16.

Figure 6:
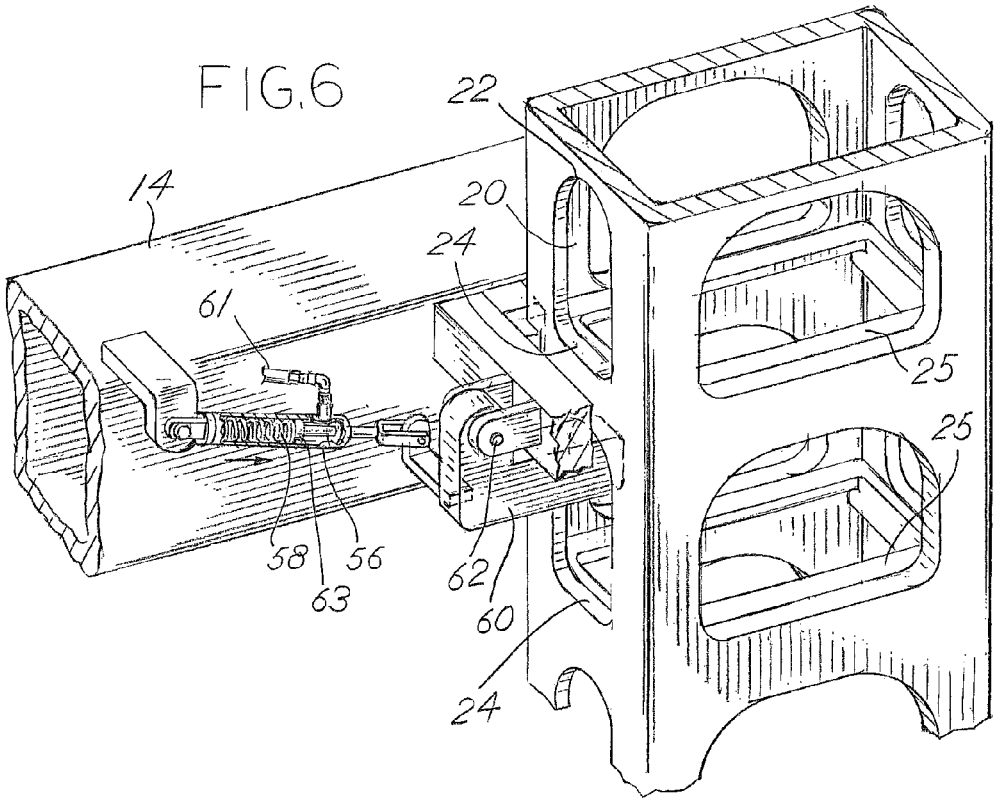
FIG. 6 is a perspective view of the safety dog shown in FIG. 5 in its first position, extended into a hole in an upright member.
Figure 7:
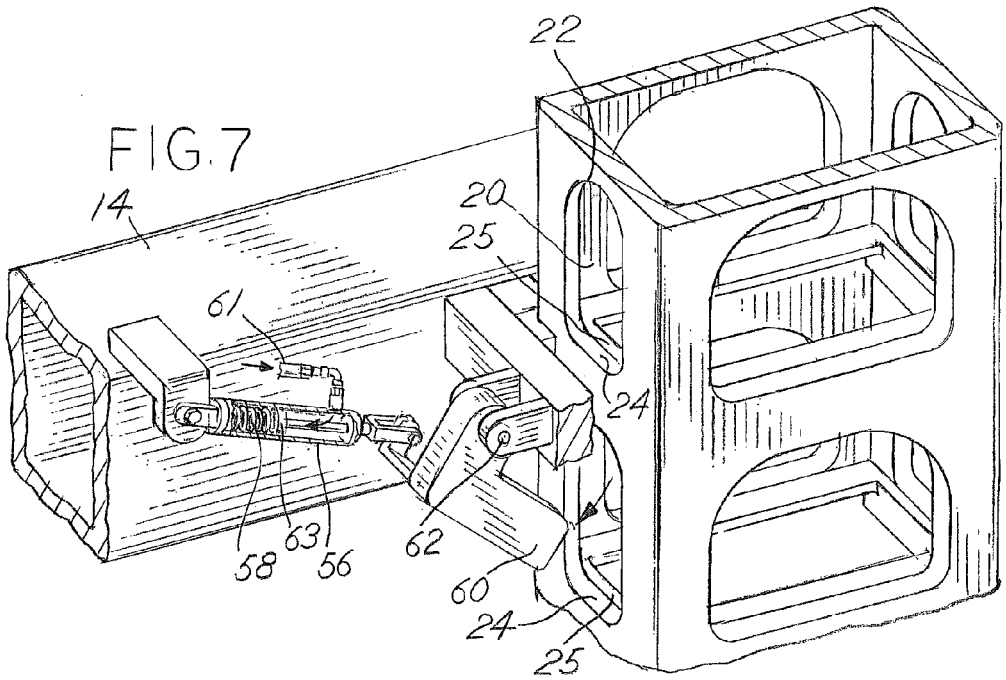
FIG. 7 is a perspective view of the safety dog shown in FIG. 5 in its second position, retracted from a hole in an upright member.

At each upright member 16 a safety dog 60 is attached to the frame 14 as best shown in FIGS. 3, 5, 6, and 7. The safety dog 60 pivots on a shaft 62 that is connected to the frame 14 as shown in FIGS. 6 and 7. A hydraulic cylinder 56 is connected to the frame and to the safety dog 60. The hydraulic cylinder 56 has an inlet 61 that is ahead of a piston 63. The hydraulic cylinder 56 contains a spring 58 that urges the safety dog 60 toward its associated upright member 16. When the platform 12 and frame 14 are stationary, the safety dog 60 will be in a first position as shown in FIG. 6. In the first position, the safety dog 60 is engaged in a hole 20 of an upright member 16. As the frame 14 moves upward and the safety dog 60 is between holes 20, the dog 60 will be urged against its associated upright member 16 by the spring 58. When the safety dog 60 encounters a hole 20, the dog 60 will remain in the hole 20 until striking the upper surface 22 of the hole 20. After striking the upper surface 22, further movement will push the dog 60 downward into its second position, which is shown in FIG. 7. The downward movement of the dog 60 compresses the spring 58 and allows the frame 14 to move upward.

If frame 14 and platform 12 were to fall downward, the safety dog 60 would catch on the lower surface 24 of the hole 20 of the adjacent upright member 16 and prevent the platform 12 from falling. When the platform 12 is intentionally moved downward, the safety dog 60 must be retracted. Retracting the safety dog 60 is accomplished by introducing hydraulic fluid through the inlet 61 to move the piston 63, which compresses the spring 58 as seen in FIG. 7.

Figure 8:
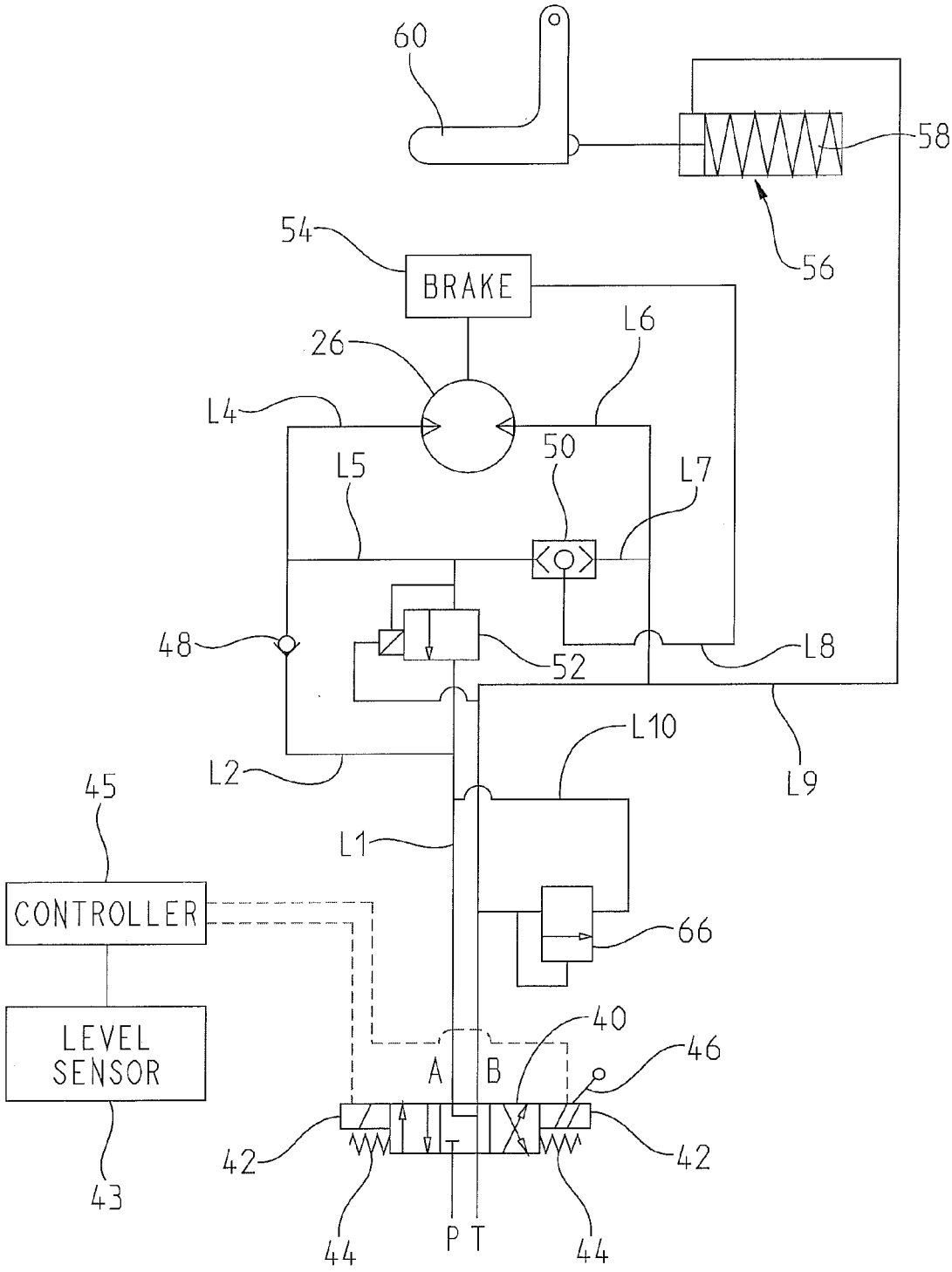
FIG. 8 is a schematic drawing of the hydraulic system.

FIG. 8 shows a schematic drawing for each hydraulic motor 26 of the liftable scaffold 10. Each motor will have a hydraulic circuit as described in FIG. 8. Each motor 26 is supplied hydraulic fluid through a proportional control valve 40. The proportional control valve 40 is connected to a tank through line T and to a pump through line P. The valve 40 has three positions. The first position, which is centered, corresponds to no pressurized hydraulic fluid being supplied to either of the motors 26. Position A corresponds to the position of the control valve 40 which raises the scaffold 10. Position B of the control valve 40 corresponds to the position needed to lower the scaffold 10. The control valve 40 has solenoids 42 on either side of the valve 40 which may receive electric signals to move the valve 40 between its positions. The valve 40 may also be controlled manually through use of a handle 46. Springs 44 center the valve in its default position as shown in FIG. 8.

When the control valve 40 is in position A, fluid will be communicated through the lines as shown in FIG. 8. In position A, pressurized fluid will enter through line P and travel through line L1. Fluid will be communicated through line L2 and through a first check valve 48. Fluid will then flow into lines L4 and L5. Line L4 delivers pressurized fluid to its associated motor 26. Fluid sent to the motor through line L4 will rotate the motor 26 in a direction to raise the scaffold 10. Line L5 delivers fluid to a shuttle valve 50 and a counterbalancing valve 52. When the proportional control valve 40 is in the A position, the counterbalancing valve 52 is closed. Line L6 is on the opposite side of the motor 26 as line L4 and receives fluid discharge from the motor 26. Line L6 is in communication with line L7. Line L7 is on the opposite side of the shuttle valve 50 as line L5. When the pressure is higher in line L5 than in line L7, as it is when the control valve 40 is in position A, fluid from line L5 will move the shuttle valve 50 to the right and the shuttle valve 50 will communicate fluid from line L5 into line L8. Line L8 communicates fluid to a spring brake 54 which locks the motor 26 in the absence of pressure in line L8. When the pressure in line L8 reaches a predetermined level of 500 PSI, the spring brake will be released and the motor 26 will rotate.

When the control valve 40 is in position B, pressurized fluid will be communicated into line L9 and line L1 will be connected to the tank. Pressurized fluid travels through line L9 to the hydraulic cylinder 56 that contains spring 58 of each of the safety dogs 60. When a predetermined pressure is present in line L9, the fluid in line L9 will be communicated into the hydraulic cylinder 56 and overcome the spring 58. The predetermined pressure to overcome the spring 58 is preferably 400 PSI. When the spring is overcome, the hydraulic cylinder will retract each safety dog 60 and pivot it about a shaft 62 that secures each dog 60 to the frame. Pressurized fluid in line L9 will also flow into line L6 and into line L7 to the shuttle valve 50. When the pressure is higher in line L7 than in line L5, as it is when the control valve 40 is in position B, fluid from line L7 will move the shuttle valve 50 to the left and the shuttle valve 50 will communicate fluid from line L7 into line L8. As mentioned earlier, when the fluid in line L8 reaches 500 PSI, the spring brake 54 will be released. Pressurized fluid in line L6 will enter the motor 26 and be discharged into line L4. Fluid entering line L4 will be prevented from flowing into line L2 by the first check valve 48. All of the fluid discharged through the motor 26 will flow through the counterbalancing valve 52. The counterbalancing valve 52 selectively restricts the flow of fluid. The counterbalancing valve 52 maintains a higher pressure in line L4 than in line L6 when the control valve 40 is in position B.

Each control valve 40, when it is in position B, governs the speed at which the scaffold 10 descends by controlling the speed at which the motors 26 rotate. As the motors 26 rotate in a direction to lower the scaffold 10, the amount of fluid entering the motors 26 is controlled by the control valve 40 associated with each motor. As more fluid is provided to the motor 26, that motor will rotate faster. The counterbalancing valve 52 acts to provide a constant 3:1 ratio of higher pressure in line L4 than in line L6 for all flow rates of fluid that are provided to the motor 26. The control valve 40 may be moved laterally to vary the amount of fluid supplied to its associated motor 26. When more fluid is supplied to the motor 26 from the control valve 40, the counterbalancing valve 52 will open to allow a higher discharge flow rate from the motor. When less fluid is supplied to the motor 26 from the control valve 40, the counterbalancing valve 52 will restrict the flow. In this manner, the pressure drop across the motor 26 is always maintained at 3:1 when the control valve 40 is in position B, and only the flow rate across the motor 26 will vary.

A level sensor 43 that measures the angle of the platform 12 is attached to the scaffold 10 and provides signals to the solenoids 42 that actuate the control valves 40 that are associated with each motor 26. When the platform 12 is moving upward, and the platform 12 is not level, meaning at some angle relative to horizontal, the level sensor will send signals to the solenoids 42 through a controller 45. The solenoid 42 on the control valve 40 that controls fluid flow to the motor 26 that is on the lower end of the platform 12 will receive a signal that opens the control valve 40 more, thereby rotating its associated motor 26 at a faster rate. The solenoid 42 on the control valve 40 that controls fluid flow to the motor 26 that is on the higher end of the platform 12 will receive a signal that closes the control valve 40 to restrict fluid flow to the motor, thereby rotating its associated motor 26 at a slower rate. Similarly, when the platform is moving downward, the speed of the motor 26 on the higher end of the platform 12 will be increased, and the speed of the lower motor 26 will be reduced. When the platform 12 is moving in either direction, the controller will continuously monitor the angle of the platform 12 relative to level and direct appropriate signals to the solenoids 42 to maintain a level condition.

When a user wishes to raise the platform, he will move a switch to start the platform 12 moving upward. This will cause the controller to send signals to the solenoids 42 on the control valves 40 to move the control valves 40 associated with each motor 26 to position A. If one end of the platform 12 is loaded with more weight than the other end, the motor 26 on that end of the platform 12 will tend to move more slowly. This will cause the heavier end of the platform to be below the lighter end. The level sensor will detect the angle relative to horizontal and transmit a signal to the controller regarding the angle of the platform.

The controller will then transmit signals to the solenoids 42 that move the control valves 40 supplying fluid to their respective connected motors 26. The solenoids 42 will open or restrict the fluid flow through the control valves 40 to govern the speed of each motor. The motor 26 on the lower end of the platform 12 will be provided more fluid and the higher motor will have its fluid flow restricted. This will cause the motor 26 on the lower end of the platform to move the lower end of the platform 12 upward more quickly and the motor 26 on the higher end to move the platform upward more slowly until the level sensor detects that the platform 12 is level. When the level sensor senses that the platform is horizontal, the flow rate to each motor 26 will be maintained at a rate that keeps each motor 26 rotating to move upward at the same speed. Generally the flow rate to a motor 26 bearing more weight will be higher than the flow rate to a motor 26 bearing less weight. Thus, the level sensor and controller automatically compensate for loading imbalances that occur without the intervention of the operator. If the operator wishes to manually control the flow rate to each motor 26, and therefore the speed of ascent of each motor 26, he may move the handle 46 on the respective control valve 40 to a particular motor 26.

Lowering the platform 12 is accomplished by moving a switch to a downward position. This causes the controller to send signals to the solenoids 42 to move the control valves 40 into position B. The counterbalancing valve 52 maintains three times as much pressure in line L4 than in line L6. The level sensor and controller act to provide signals to the solenoids 42 so that each motor 26 travels the same distance downward. If the operator wishes to manually control the rate of descent for a particular motor 26 he may move the handle 46 to change the flow rate for that motor 26. When the platform 12 has reached the bottom of the upright members 16 the pressure in line L10 will be limited by a relief valve 66. When the pressure reaches high limit of 800 PSI, the pressure relief valve 66 will open to allow fluid in line L9 to pass through line L10 into line L1, which is connected to the tank when the control valve 40 is in position B. This prevents the pinions 30 from being driven by their associated motors 26 with enough force to damage the upright members 16.

The invention is not limited to the details given, but may be modified within the scope of the following claims.

What is claimed is:

1. A system for lifting a platform comprising:

a platform including a frame;

a plurality of upright members each having a plurality of equally spaced holes longitudinally aligned, each of said holes having an upper surface and a lower surface;

each upright member having a corresponding hydraulic motor attached to said frame, and a corresponding pinion with an axis carried by said frame and driven by said corresponding hydraulic motor, each of the pinions having a plurality of equally spaced radially extending teeth, each tooth respectively including respectively opposing tabs supporting a respective roller journaled between the tabs over a journal bushing over a shaft, the roller offset from a center of the tabs so a back of the roller is located between opposing tabs of the tooth and a front of the roller is located between two adjacent teeth, said roller being freely rotatable about the shaft, said teeth capable of engaging said upright members wherein said teeth, each at said respective tabs and rollers, are capable of projecting into adjacent holes in said upright members wherein said front of the rollers can roll over said lower surfaces of said adjacent holes when said motors rotate said pinions in a direction to raise or lower said frame and platform; and wherein each respective motor being supplied fluid through a corresponding proportional control valve that directs and selectively restricts fluid flow to each corresponding motor, each motor having the corresponding pinion attached thereto, said proportional control valves having solenoids that move said control valves to control fluid flow to said corresponding motor, each solenoids being responsive to electric signals to initiate movement of said corresponding control valve, a level sensor for sensing an angle of said platform with respect to an horizontal orientation and providing said electric signals to actuate said solenoids to move said control valves connected to each motor so that each of said motors rotates the attached corresponding pinion at a rate to maintain each motor at an equal distance traveled along the upright member during raising or lowering of said platform, wherein if the platform is moving upwards, the fluid flow to the control valve of the motor on a higher end of the platform will be limited thus rotating the motor on the higher end slower, and wherein if the platform is moving downwards, the fluid flow to the control valve of the motor on a lower end of the platform will be limited thus rotating the motor on the lower end slower.

2. A system for lifting a platform as claimed in claim 1, wherein each control valve has a lever for manually controlling the corresponding control valve.

3. A system for lifting a platform as claimed in claim 1, wherein each of said upright members have reinforcement plates affixed to said upright members below said holes defining at least in part said lower surfaces of said holes.

* * * * *